US006521906B1

(12) United States Patent
Beying et al.

(10) Patent No.: US 6,521,906 B1
(45) Date of Patent: Feb. 18, 2003

(54) METHOD AND APPARATUS FOR MEASURING THE DISTORTION ANGLE OF A STRIP OF TEXTILE, WHEREIN A SENSOR ARRAY SCANS AT PROGRESSIVELY ALTERED ANGLES

(75) Inventors: Karl-Heinz Beying, Riedenburg (DE); Gunter Abelen, Zeitlarn-Regendorf (DE); Helmut Klaehsen, Geldern (DE)

(73) Assignee: Mahlo GmbH & Co. KG, Saal/Donau (DE)

( * ) Notice: Subject to any disclaimer, the term of this patent is extended or adjusted under 35 U.S.C. 154(b) by 0 days.

(21) Appl. No.: 09/719,218

(22) PCT Filed: Apr. 20, 2000

(86) PCT No.: PCT/EP00/03611

§ 371 (c)(1),
(2), (4) Date: Jan. 30, 2001

(87) PCT Pub. No.: WO00/66829

PCT Pub. Date: Nov. 9, 2000

(30) Foreign Application Priority Data

Apr. 30, 1999 (DE) ..... 199 19 966
Jun. 24, 1999 (DE) ..... 199 28 986

(51) Int. Cl.[7] ..... G01V 8/00

(52) U.S. Cl. ..... 250/559.37; 250/559.4; 250/559.44; 250/559.46; 356/429; 356/430; 356/238.1; 356/238.2; 356/238.3

(58) Field of Search ..... 250/559.29–559.49; 356/429, 430, 238, 375, 419, 238.1, 238.2, 238.3

(56) References Cited

U.S. PATENT DOCUMENTS 2,106,612 A 1/1938 La Pierre et al. ..... 26/52
4,414,476 A * 11/1983 Maddox et al. ..... 250/563
4,786,177 A * 11/1988 Beckstein et al. ..... 356/429
4,890,924 A * 1/1990 Beckstein ..... 356/429

FOREIGN PATENT DOCUMENTS

| | | |
|---|---|---|
| DE | 674750 | 4/1939 |
| DE | 1 635 266 | 12/1966 |
| EP | 0 291 729 | 4/1988 |
| GB | 1169778 | 12/1967 |

* cited by examiner

*Primary Examiner*—Stephone B Allen
*Assistant Examiner*—Christopher W. Glass
(74) *Attorney, Agent, or Firm*—Merchant & Gould P.C.

(57) ABSTRACT

Method of measuring a distortion angle between the longitudinal extent of the weft threads or rows of stitches in a textile strip (T) that is being continuously transported in a transporting apparatus (M) and the perpendicular to the transport direction, by means of a lighting arrangement (100A), a photoelectric sensor arrangement (107) with a plurality of sensor elements and an evaluation device (115) connected to the sensor arrangement for processing the values sampled from the sensor fields in order to obtain the distortion angle, wherein an arrangement of sensor elements with a plurality of rows and columns is used in which individual elements can be accessed as desired, and in a sequence of scanning steps different predetermined groups of sensor elements are interrogated, each of which is situated substantially on a sensor-field line, the groups involved in each scanning step being determined such that the scanned sensor-field lines are positioned at progressively altered angles with respect to the transport direction.

19 Claims, 3 Drawing Sheets

METHOD AND APPARATUS FOR MEASURING THE DISTORTION ANGLE OF A STRIP OF TEXTILE, WHEREIN A SENSOR ARRAY SCANS AT PROGRESSIVELY ALTERED ANGLES

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The invention relates to a method of measuring the distortion angle of the weft threads or rows of stitches in a strip of textile, and to an apparatus for implementing this method.

2. Description of Related Art

In view of the fact that the distortion angle of a woven or knitted strip of textile must be measured so that the result of the measurement can be used in machines for the automatic correction of textile strips (tentering or straightening machines), such measurement is a technical problem that has existed for decades and has already been solved in a more or less costly and reliable way.

The German patent DE-PS 674 750 describes a control mechanism for the automatic straightening of woven, light-transmitting cloth strips for web-tentering or similar machines, which derives its input signals from an arrangement of photoelectric cells that are illuminated by light passing through narrow slits, which are oriented at an angle to the transport direction of the cloth strip, and then through the moving web. By comparison of the signals from photocells associated with two slits that are perpendicular to one another, as a function of time, a control signal is obtained for tentering chains that have a straightening action on the web, although this arrangement does not explicitly measure the distortion angle.

In the patent DE-OS 1 635 266 a method of determining the weft-thread position of moving strips of woven material is described, along with an apparatus for implementing this method, in which a photoelectric detection device is likewise employed. The apparatus described here also, in one embodiment, comprises slots arranged in a V shape, with each of which are associated two photocells that are illuminated through the web. In another embodiment the measurement device comprises one photocell and one slot which, together with the photocell, can be moved back and forth like a pendulum, so that when the time-dependence of the photocell signal is evaluated in synchrony with a signal indicating position of the slot, information comparable to that obtained with the two-slot arrangement is provided. Disadvantages in a certain sense are the inertia of the mechanically moved arrangement and its mechanical wear and tear.

In the patent EP-B 0 291 729 another method and an apparatus for measuring the weft-thread or stitch-row position of strips of textile are described, in which by means of a photoelectric transducer a slit-like section is observed; in this case the transducer is formed by an arrangement of CCD arrays with a plurality of sensor fields (to be read out in series). In this printed specification several variants of concrete arrangements having one or two such CCD-sensor arrays are described, as well as a number of variants for evaluating the sensor signals. The evaluation principle is that as the textile strip moves past, the weft threads (which appear as dark fields) and the intervening spaces (which appear light) continuously illuminate the individual sensor elements of the CCD array(s) more or less strongly in alternation, and the corresponding light-dark signal sequence is analyzed digitally by a threshold-value discrimination. The algorithm for this analysis is of course chosen in accordance with whether one or two sensor arrays are employed and how these are positioned relative to the transport direction. In this solution the information obtainable from the results of the evaluation depends substantially on the specific design of the sensor arrays chosen, and is to some extent satisfactory only if two sensor arrays are used; however, there is need for improvement with respect to the accuracy of the results and the flexibility of the arrangement for differentiated evaluations.

BRIEF SUMMARY OF THE INVENTION

It is thus the object of the invention to disclose a method of this generic kind and an apparatus for implementing this method that is distinguished by high accuracy and reliability as well as versatility with respect to various evaluation tasks.

This object is achieved in regard to its methodological aspect by a method briefly described as follows. A method of measuring a distortion angle between the longitudinal extent of the weft threads or rows of stitches in a textile strip (T) that is being continuously transported in a transporting apparatus (M) and the perpendicular to the transport direction, by means of a lighting arrangement (100A, 200A), a photoelectric sensor arrangement (FIG. 1; FIG. 2; 107) with a plurality of sensor elements that are interrogated individually to obtain discrete light-dark sampling values, and an evaluation device (115) for processing the values sampled from the sensor fields in order to obtain the distortion angle is performed by using as a sensor arrangement an arrangement (FIG. 1; FIG. 2) of sensor elements with a plurality of rows and columns in which individual elements can be accessed as desired. In a sequence of scanning steps different predetermined groups of sensor elements are interrogated, each of which is situated substantially on a sensor-field line (FIG. 1; FIG. 2). The groups involved in each scanning step are determined such that the scanned sensor-field lines, which in particular have one sensor field in common, are positioned at progressively altered angles with respect to the transport direction. With regard to the implementation aspect, the invention is achieved by an apparatus briefly described as follows. The apparatus comprises a lighting arrangement (100A, 200A), a photoelectric sensor arrangement (FIG. 1; FIG. 2; 107) composed of sensor elements, each accessible individually as desired, disposed in a plurality of rows and columns, a scanning-control device (113) to define the predetermined sensor-field line at each scanning step, and an evaluation device (115) connected to the sensor arrangement for processing the values sampled from the sensor elements in order to determine the distortion angle.

The invention includes the essential idea of producing an electronically moved slot, so to speak, linked to the fundamentally well-established principle of the moving slot and the use of a photoelectric sensor arrangement with a plurality of sensor fields. It further includes the idea of using for this purpose a field arrangement, driven in a suitable manner, that consists of optionally selectable photoelectric sensor elements with a plurality of arrays and slots. The field arrangement is controlled in such a way that in each detection step of the measurement procedure a linear array of sensor elements (in the following termed briefly "sensor-field line") is scanned and in each detection step the scanning configuration is changed in such a way that in comparison to the preceding step a (virtual) rotation of the sensor-field line occurs.

By this means, in one scanning cycle over a predetermined angular range a "rotating sensor array" is realized, which imitates a swingable detection slot but has no inertia and is not subject to wear; furthermore, depending on the number of sensor elements in the arrangement and the resulting resolution of the apparatus, it allows extensive additional possibilities for analysis. The electronically achieved range of rotation angles covered in a scanning and analysis cycle is selected in dependence on the particular conditions for a specific form of use, as is the (virtual) rotation-angle increment between the individual scanning steps, and is maximally 180°.

The above-mentioned (virtual) rotation of a sensor-field line, which is realized by suitable choice of the sensor elements within a two-dimensional sensor array that are to be scanned in consecutive steps, can also take the form of "oscillating" about an intermediate orientation of the sensor-field line formed by the selected sensor fields. In this case, in particular when reference is made to previously measured values—that is, taking into account a distortion that has already formed in the textile strip—the further development of this distortion can be followed more accurately in an advantageous way. That is, when by this means in consecutive sampling or scanning steps no relatively large angular increments are detected, but rather small changes in the vicinity of the distortion angle that had formed in the past—which naturally functions particularly well when the arrangement comprises very many sensor fields—the accuracy of the measurement can be enhanced.

Even in the case of such a design, however, with sensor-field lines that (virtually) oscillate about an intermediate orientation, in a further embodiment it is useful after a certain number of steps to insert a scanning step of a sensor-field line defined by a larger angular increment, so as not to lose sight of the actual orientation of the weft threads or rows of stitches if there are sudden changes in the distortion angle.

The method outlined here can be implemented with no difficulty by a microprocessor-controlled measurement arrangement with corresponding storage possibilities for previously measured values. It is also possible to select among various stored program sequences, in which series of scanning steps with orientations of the scanned sensor-field line that vary by small angular amounts (rotating or oscillating) alternate with virtual rotations by larger angular amounts.

In a preferred embodiment the sensor arrangement is a matrix arrangement in rectangular or square form, and the scanned sensor-field lines are determined by actuating this matrix arrangement in such a way that all sensor-field lines are of substantially the same length. Therefore during their electronic rotation within the overall arrangement in the course of a scanning cycle they substantially—depending on the choice of virtual pivot point—describe a sector of a circle or two diametrically opposed sectors (maximally a complete circle). In view of this, it is of course also possible to employ a circular sensor arrangement at the outset, but in the normal case this option would not be chosen because of the cost advantages of square or rectangular sensor arrays, which are manufactured in large numbers.

To monitor the distortion angle of a broad strip of material, and in particular also to detect garland-like distortion, it is advantageous to use a plurality of sensor arrangements distributed over the width of the textile strip, which are scanned synchronously with one another in the manner outlined above, and the output signals of which are evaluated in connection with one another in order to obtain a full-width distortion profile for the textile strip.

The method proposed here and the associated apparatus, because of their high resolution and the very short cycle time for the individual detection steps, make it possible to insert additional detection steps between consecutive scanning cycles (or, where appropriate, between individual scanning steps within a cycle). Such additional steps serve in particular as a means of obtaining a complete picture of the textile strip or a picture that reveals the thread density by counting the number of passing threads, or in order to monitor processes of stretching or shrinking. These possibilities emphatically document the extraordinary versatility of the proposed solution.

In an embodiment preferred with respect to the performance parameters and cost, the photoelectric sensor arrangement is a CMOS array (in particular in the form of a matrix) in which the sensor fields are formed by photodiodes and which preferably comprises 512×512 or more sensor fields (pixels). Such a number of sensor fields enables an alternative approximation of linear sensor groups in a large number of angular positions relative to the transport direction. In addition it enables an informative, complete picture to be obtained for further evaluation tasks.

The lighting arrangement belonging to the overall apparatus, which preferably operates by transmitted light, is in particular designed as an infrared lighting arrangement. Implementation in the form of an LED array (in particular likewise matrix-shaped) is advantageous in comparison to the customarily used arrangements of incandescent bulbs in that it enables practically inertia-free control and can achieve a distinctly longer working life. If in a particularly advantageous design the LEDs of the array are so constructed that their emission behavior is matched to the sensitivity curve of the sensor elements, in particular the photodiodes of the CMOS array, in addition considerable savings in energy can be achieved.

The lighting arrangement is advantageously housed all together in a lighting head that can be called a "spotlight", the dimensions and positioning of which are designed to suit the sensor field disposed on the opposite side of the textile strip, which can be housed in a scanning or measurement head. The measurement head and the lighting head, or a plurality of such heads that can be employed together, are each provided with a mechanism to adjust the head position or to guide the head. In addition the measurement heads are provided with an evaluation unit—advantageously contained in a separate housing—to collect and evaluate the measured data. This unit comprises a suitable interface for incorporation into the system, for example an ethernet interface, and can function as server in a TCP-/IP network for clients such as one or more PCs with which to operate the arrangement and display the results graphically, a straightening machine to make use of the results of the measurements, a master computer or the like. A network module consisting of several measurment and lighting heads then provides a complete distortion profile of the textile strip, which can be graphically displayed by the above-mentioned PC and where appropriate either processed further or used directly, by way of a straightening-machine module, to control a straightening machine to eliminate the distortion in the textile strip. Also, however, the PC or PCs can be used to influence the control of the measurement process and the evaluation of the measured data, for example by selecting different angular positions or rotation-angle increments of the sensor-field lines or choosing particular filter algorithms in the evaluation of the results.

Additional advantages and useful features of the invention will be apparent from the following description of preferred exemplary embodiments with reference to the figures.

BRIEF DESCRIPTION OF THE SEVERAL VIEWS OF THE DRAWINGS

FIGS. 1 and 2 are each diagrams of a 16×16 sensor array to make clear different ways to implement the principle of the electronic realization of a "swingable slot" as explained above.

DETAILED DESCRIPTION OF THE INVENTION

Figure 1:
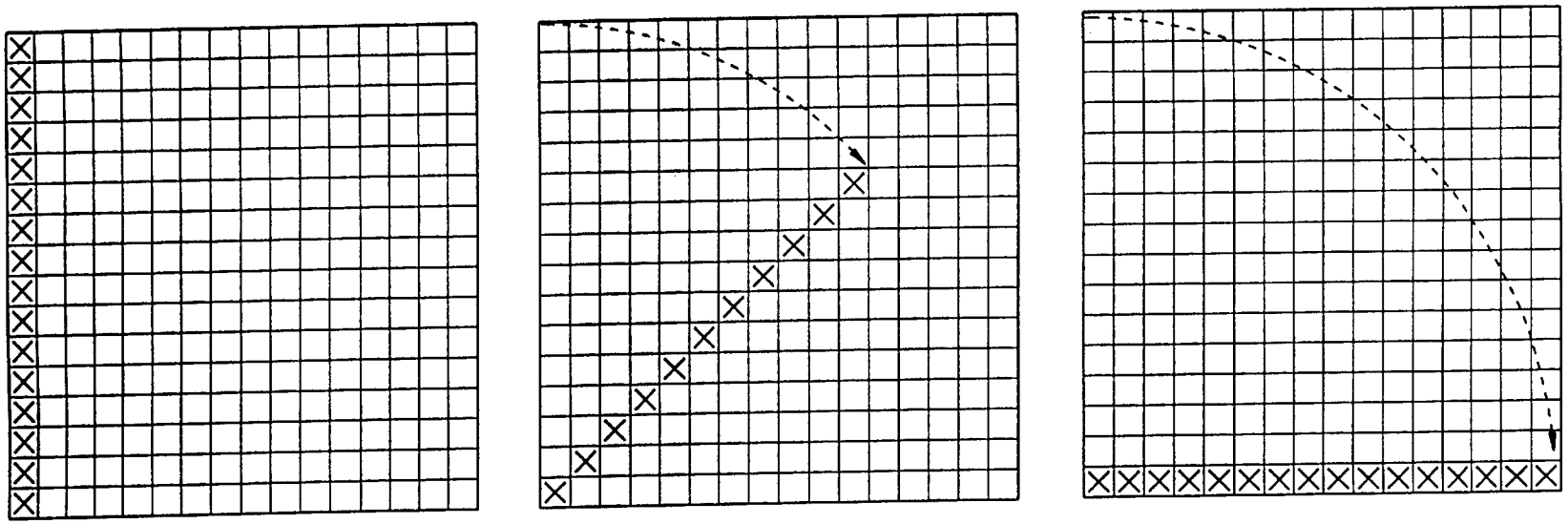
FIG. 1 is a schematic diagram of a sensor arrangement according to a first embodiment of the invention in three sampling steps.

In the three sections of FIG. 1 crosses indicate the sensor elements in a sensor arrangement that are activated or scanned in three steps during a sampling cycle to implement the method in accordance with the invention. In the first sampling step all the sensor elements in the first column of the sensor array are activated, in the second step eleven sensor elements on the diagonal of the sensor array (beginning at the bottom left element), and in the third sampling step all sixteen sensor elements in the bottom row of the array are scanned. This implementation is readily achieved with a CMOS sensor arrangement in which the sensor elements can be interrogated individually as desired. Even the few scanning steps shown here make it clear that by this means it is possible to rotate electronically a line of sensor elements, which is equivalent to an observation "slot". In the variant shown in FIG. 1 the angle of rotation is maximally 90°, but it can also be made smaller.

Figure 2:
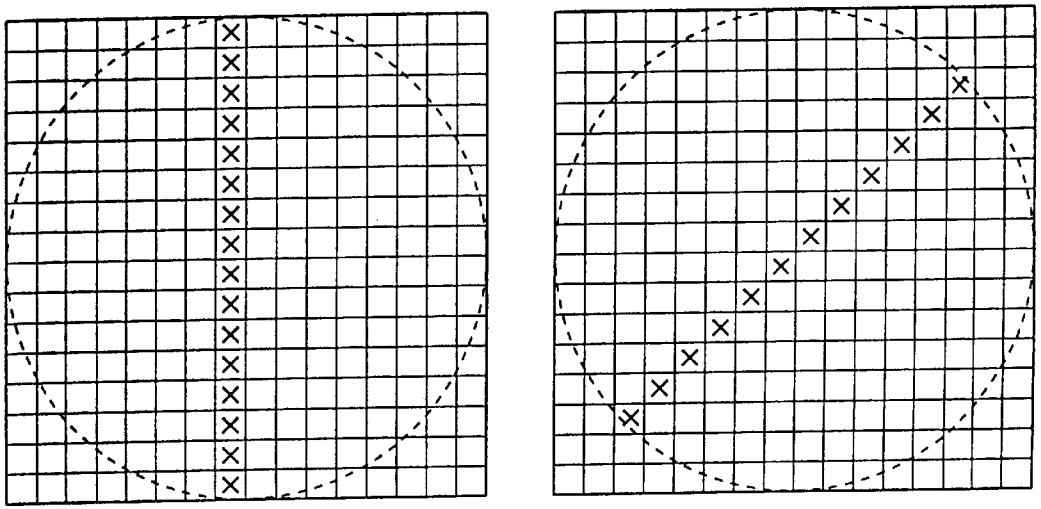
FIG. 2 is a schematic diagram of a sensor arrangement according to a second embodiment of the invention in two sampling steps.

In FIG. 2 another variant is sketched, in two selected sampling steps; here the virtual rotation of the sensor line occurs substantially about the midpoint of a 16×16 photodiode array. Here, again, in the sampling steps in which a column or row of the sensor arrangement is activated all sensor elements in the column or row are used to form the "slot", whereas in those steps in which a sensor-field line at an angle to the edges of the array is scanned, a smaller number of sensor elements is activated, so as to keep the geometric length of the virtual slot approximately constant.

With a view towards a practical implementation it should be noted that in practice sensor arrays with a considerably larger number of sensor elements or pixels (preferably 512×512 pixels or more) are used, so that angular positions other than the 0°, 45° and 90° shown in FIGS. 1 and 2 can be produced to a good approximation with linearly arranged groups of sensor elements.

Figure 3:
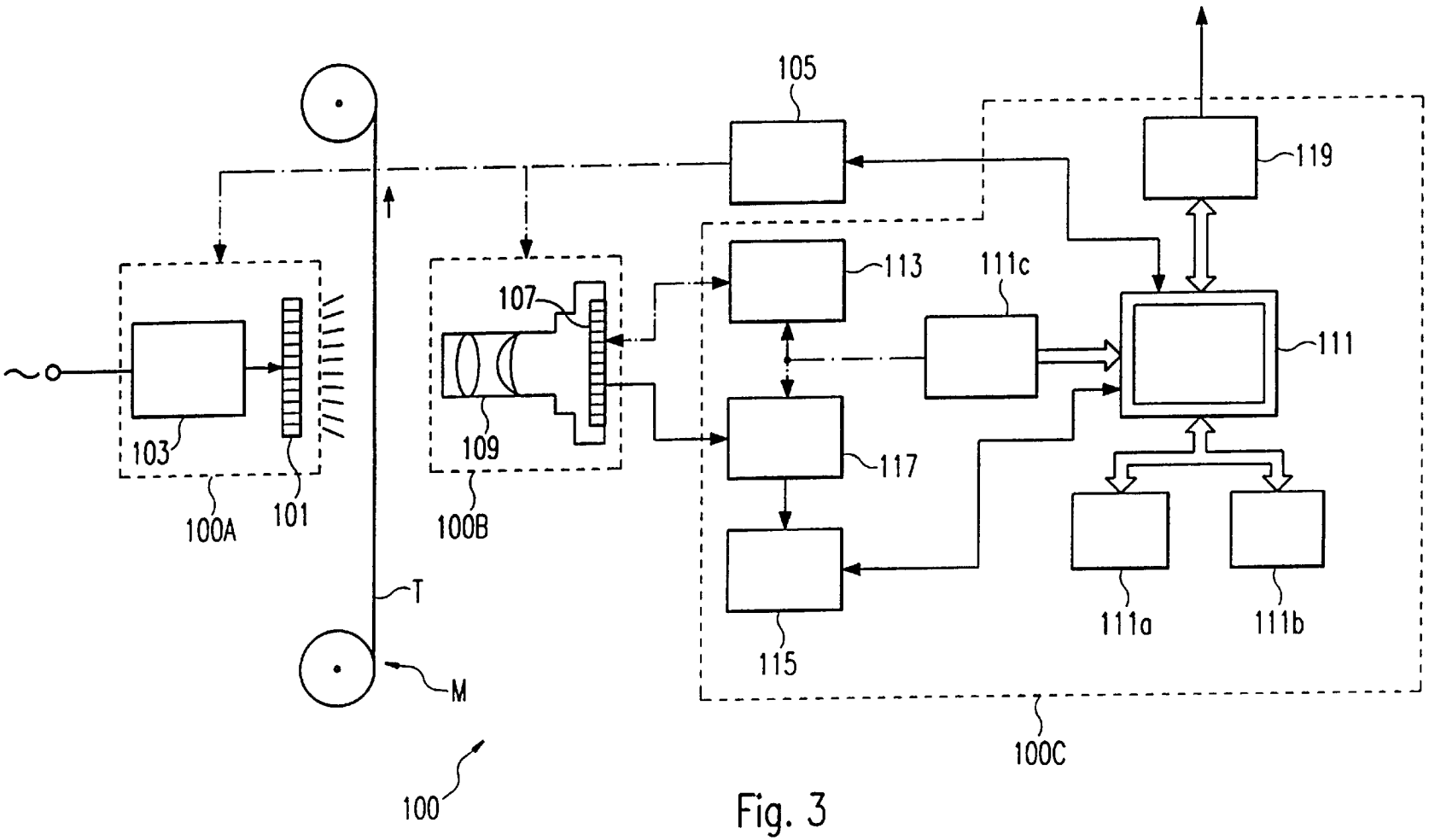
FIG. 3 is a block diagram illustrating the function of an apparatus, to explain an exemplary embodiment.

FIG. 3 shows, as a first exemplary embodiment of an apparatus to implement the method in accordance with the invention, a distortion-angle measurement apparatus 100 to measure the distortion of the weft threads in a textile strip T, which is being transported along a tentering machine M in the transport direction indicated by an arrow in the figure. Light passes through the textile strip T from an infrared LED array 101, which is driven by a lighting control unit 103 and is housed therewith in a lighting head ("spotlight") 100A. The lighting control unit 103 is so constructed as to enable individual, inertia-free actuation of the LEDs in the LED array 101. The lighting head 100A is connected to a guidance mechanism 105 (which in the figure, like the other components, is shown merely symbolically as a function block).

On the other side of the textile strip T, opposite the lighting head 100A, is disposed a measurement head 100B that contains a 512×512 CMOS sensor array 107 in front of which is positioned an imaging lens (objective) 109. The measurement head 100B is also mechanically connected to the guidance mechanism 105 and can be moved thereby relative to the textile strip T, in synchrony with the lighting head 100A.

Associated with the measurement head 100B is a driving and evaluation unit 100C, the essential component of which is a microprocessor 111 equipped as is customary with working and program memories 111*a*, 111*b* and a timing unit 111*c*. To the microprocessor 111 is connected a scan-control device 113, which in turn on its output side is connected to the CMOS sensor array 107 and by means of which, in order to implement the imaging principle explained above, selected groups of sensor elements are activated or scanned.

To evaluate the data received from the selected sensor-element groups, a sensor-evaluation device 115 is also connected to the microprocessor 111. On its input side this device is connected to a sensor-data buffer memory 117, which in turn on its input side is connected to the sensor array 107 and into which—synchronized by the timing unit 111*c* so that particular scanning steps and cycles can be identified—are sent the image data provided by the previously specified sensor-field lines. The evaluation of these image data in the sensor-evaluation device 115 occurs according to evaluation procedures or algorithms known per se from the sampling method employing a real moving slot (cf., e.g., DE-OS 1 635 266 and EP-B 0 291 729), which are stored in the program memory 111*b*.

Figure 4:
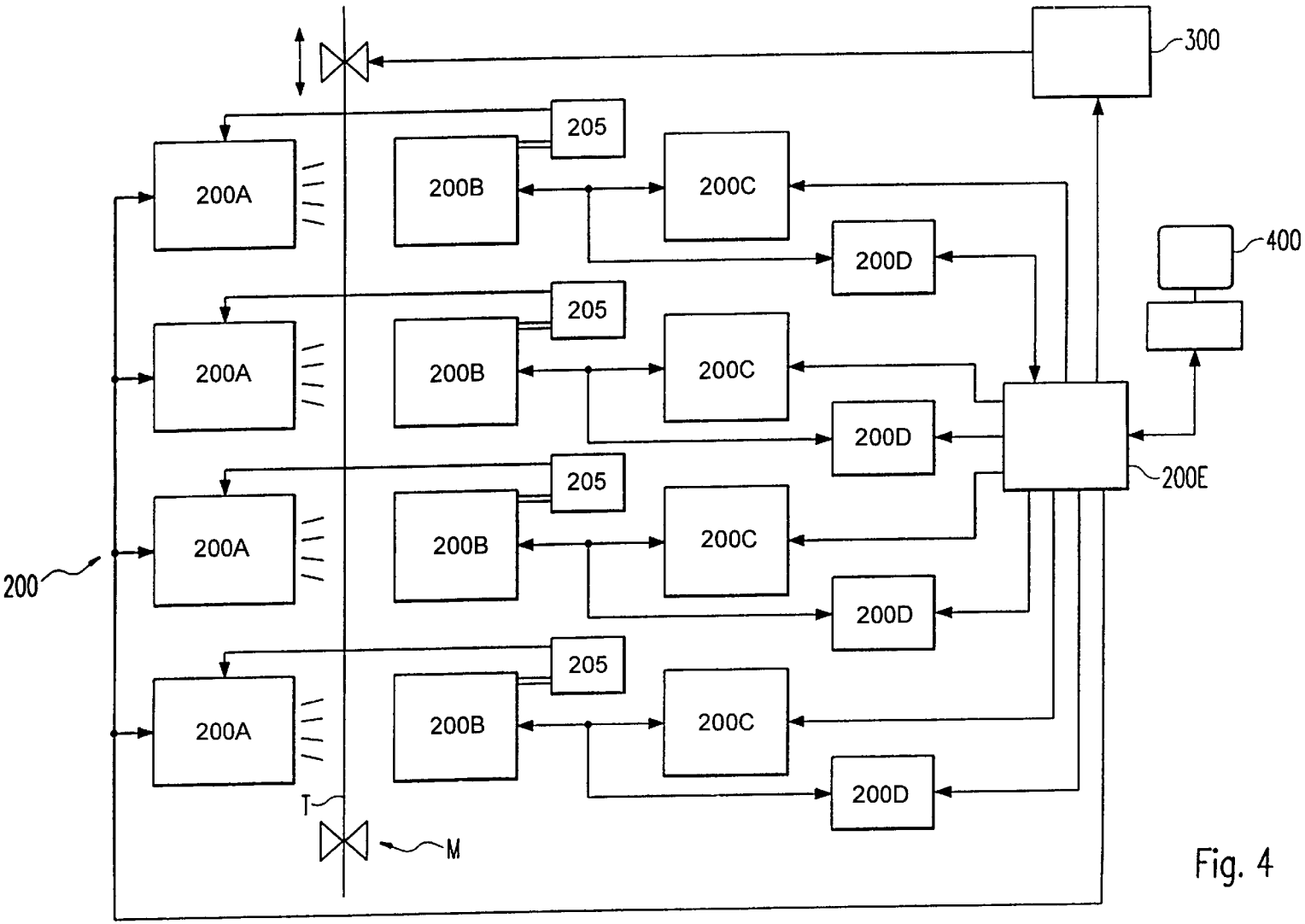
FIG. 4 is a block diagram illustrating the function of a whole arrangement, to explain another exemplary embodiment.

In the evaluation device 115, prior to the actual evaluation, a preprocessing (likewise known in principle from digital image processing) of the sensor signals can be carried out in the form of suitable filtering or the like. Again, the relevant preprocessing algorithms or filter characteristics are stored in the program memory 111*b* or can be input from an external source by way of an interface 119. The interface 119 can also be used to output the data produced by the evaluation device 115 for further processing or other utilization (regarding which, see below). In the program memory 111*b* are also stored the definitions of the sensor-field lines used in the individual scanning steps of a scanning cycle to determine the distortion angle, and these are transferred in a stepwise manner, by way of the microprocessor 111, to the scanning control device 113. Alternatively, the latter device can comprise an internal sensor-configuration memory (not shown). FIG. 4 shows a distortion-profile detection arrangement 200 to detect an overall distortion profile of the textile strip T, which is associated with a tentering machine M together with a straightener-control device 300. The distortion-profile detection arrangement 200 in the embodiment illustrated here comprises four lighting heads 200A and four measurement heads 200B, distributed over the width of the textile strip T and connected in each case to a driving and evaluation unit 200C. The structure of these components corresponds for example to that described above with reference to FIG. 1 and therefore is not explained again here.

For each of the measurement heads 200B there is provided, in addition to a driving and evaluation unit 200C for the measurement of distortion, an image-processing stage 200D to receive an image of a section of the textile strip T that can be obtained with the sensor arrangement as a whole. The image-processing stages 200D, like the driving and evaluation units 200C, comprise an interface for connection to a network module 200E. This interface has a server function with respect to several clients: the straightener-control device 300 to straighten the textile strip T, a guidance controller 200F for the coordinated movement of the lighting and measurement heads 200A, 200B by means of the associated guidance mechanisms 205, and an additionally connected PC 400. The PC is used in particular for inputting evaluation specifications to the driving and evaluation units 200C and also, where appropriate, for inputting control data for the lighting heads 200A and/or the guidance controller 200F, and furthermore of course also displays a graphic representation of the detected distortion profiles and images of the textile strip and, where required, other results of the evaluation.

The embodiments of the invention are not limited to the examples explained above, but can also include many modifications thereof.

For example, in particular the LED arrangement described here can also be employed as a lighting device for measuring the distortion angle of a textile strip regardless of whether the sensor arrangement is constructed as proposed here.

List of Reference Numerals

100 Distortion-angle measuring apparatus
100A; 200A Lighting head
10C; 200C Driving and evaluation unit
101 Infrared LED array
103 Lighting control unit
105; 205 Guidance mechanism
107 CMOS sensor array
109 Imaging lens (objective)
111 Microprocessor
111*a* Working memory
111*b* Program memory
111*c* Timing unit
113 Scanning control device
115 Sensor-evaluation device
117 Sensor-data buffer memory
119 Interface
200 Distortion-profile detection arrangement
200D Image-processing stage
200E Network module
200F Guidance controller
300 Straightener control device
400 PC
M straightening machine
T textile strip

What is claimed is:

1. Method of measuring a distortion angle between a longitudinal extent of weft threads or rows of stitches in a textile strip that is being continuously transported in a transporting apparatus and perpendicular to the transport direction, comprising the steps of:

individually interrogating, by means of a lighting arrangement, a photoelectric sensor arrangement with a plurality of sensor elements, so as to obtain discrete light-dark sampling values, processing the sampling values with an evaluation device to obtain the distortion angle, wherein the sensor arrangement comprises an arrangement of sensor elements comprising a plurality of rows and columns, in which individual elements thereof can be accessed as desired, and interrogating different predetermined groups of sensor elements in a sequence of scanning steps, each group being situated substantially on a sensor-field line, wherein the groups involved in each scanning step are determined such that scanned sensor-field lines are positioned at progressively altered angles with respect to the transport direction.

2. Method according to claim 1, wherein a scanning cycle comprises a plurality of scanning steps in which the angular position is varied through a predetermined range, after which the distortion angle is determined on the basis of the sensor data.

3. Method according to claim 1, wherein the sensor arrangement comprises a matrix arrangement, such that all scanned sensor-field lines have substantially the same length so that in the matrix arrangement in the course of a scanning cycle the scanned sensor-field lines approximately describe at least a sector of a circle.

4. Method according to claim 1, wherein a plurality of sensor arrangements distributed over a width of the textile strip are used and are interrogated in combination and synchronously in order to obtain a full-width distortion profile for the textile strip.

5. Method according to claim 1, wherein between every two consecutive scanning steps and/or scanning cycles at least one additional detection step is inserted, for obtaining a picture of the textile strip.

6. Apparatus for implementing method of measuring a distortion angle between a longitudinal extent of weft threads or rows of stitches in a textile strip that is being continuously transported in a transporting apparatus and perpendicular to the transport direction, comprising:

a lighting arrangement, a photoelectric sensor arrangement comprising sensor elements, each sensor element being accessible individually as desired, the sensor elements being disposed in a plurality of rows and columns, and whereby groups of sensor elements involved in each scanning step are determined such that scanned sensor-field lines are positioned at progressively altered angles with respect to the transport direction, a scanning-control device adapted to define a predetermined sensor-field line at each scanning step, an evaluation device connected to the sensor arrangement for processing values sampled from the sensor elements in order to determine the distortion angle.

7. Apparatus according to claim 6, wherein the photoelectric arrangement comprises a CMOS array of photodiodes.

8. Apparatus according to claim 7, wherein the CMOS array comprises at least 512×512 sensor elements.

9. Apparatus according to claim 6, wherein the lighting arrangement is a transmitted-light infrared lighting arrangement.

10. Apparatus according to claim 6, wherein the lighting arrangement comprises an LED array.

11. Apparatus according to claim 7, wherein the LED array has an emission characteristic that matches a sensitivity of the photodiodes.

12. Apparatus according to claim 6, further comprising at least three sensor arrangements connected to a common evaluation device.

13. Apparatus according to claim 6, further comprising additional means for image processing of image signals generated by the sensor arrangement.

14. Method according to claim 1, wherein the scanned sensor-field lines have one sensor field in common.

15. Method according to claim 2, wherein the predetermined range is 180°.

16. Method according to claim 3, wherein the scanned sensor-field lines approximately describe a complete circle.

17. Apparatus according to claim 7, wherein the CMOS array is constructed in the form of a matrix.

18. Apparatus according to claim 10, wherein the LED array is in a matrix form.

19. Apparatus according to claim 12, further comprising a number of lighting arrangements equal to a number of sensor arrangements.

* * * * *